United States Patent [19]

Derler

[11] 4,062,292

[45] Dec. 13, 1977

[54] UTILITY TAMPER WORKHEAD

[75] Inventor: Charles J. Derler, Ludington, Mich.

[73] Assignee: Jackson Vibrators, Inc., Ludington, Mich.

[21] Appl. No.: 624,764

[22] Filed: Oct. 22, 1975

[51] Int. Cl.[2] ..... E01B 27/16

[52] U.S. Cl. ..... 104/12

[58] Field of Search ..... 104/12, 7 R, 7 A, 7 B, 104/8, 10

[56] References Cited

U.S. PATENT DOCUMENTS

| | | | |
|---|---|---|---|
| 2,482,111 | 9/1949 | Jackson | 104/12 |
| 2,821,935 | 2/1958 | Bean | 104/12 |
| 2,899,909 | 8/1959 | Jackson | 104/12 |
| 3,070,034 | 12/1962 | Derler | 104/12 |
| 3,387,567 | 6/1968 | Reynolds | 104/12 |
| 3,608,498 | 9/1971 | Plasser et al. | 104/12 |
| 3,625,156 | 12/1971 | Anderson | 104/12 |
| 3,669,025 | 6/1972 | Plasser | 104/12 |

FOREIGN PATENT DOCUMENTS

| | | | |
|---|---|---|---|
| 2,266,767 | 10/1975 | France | 104/12 |
| 399,504 | 3/1966 | Switzerland | 104/12 |

*Primary Examiner*—Robert J. Spar
*Assistant Examiner*—Carl Rowold
*Attorney, Agent, or Firm*—Leydig, Voit, Osann, Mayer & Holt, Ltd.

[57] ABSTRACT

A railroad track ballast tamper, operating on-track, having a workhead resiliently and pivotally supporting a pair of platforms on each side of each rail with tamping blades pivoted on each platform and vibration motors fixed to each platform. Lowering the workhead tilts the blades toward the rail because of the platform pivot locations, and actuators coupling the blades squeeze the blades toward the tie so as to tamp, with vibration and squeezing action, that region beneath the ties and under the rail.

5 Claims, 6 Drawing Figures

10
19
23
21
22
17
46
26
25
18
34
28
24
36
15
16
32
41
37
35
38
27
11
12
13

12
43
31
33
38
4
17
35
36
37
11
23
34
24
3

UTILITY TAMPER WORKHEAD

This invention relates generally to railroad track ballast tamping machinery and more particularly concerns a workhead for on-track tamping machines.

On-track tampers are intended to place and consolidate, i.e., tamp, ballast about and beneath the ties of railroad track on which the machine runs. While the objective remains basically the same, such tampers vary from high speed, virtually fully automatic production machines to lightweight devices that are only a little more complicated than a single blade, hand tamper. Obviously, the cost of acquiring and operating a tamper is dependent on its size, power and complexity so that railroads or contractors interested in laying or maintaining track try to match a tamping machine to the job to be accomplished.

A utility tamper is one whose size and power falls generally between a main line production tamper and a small switch and yard machine and, as such, a utility tamper should, from a successful commercial standpoint, be capable of performing virtually every tamping job with some degree of efficiency while still being sufficiently economical to qualify as a "smaller" machine.

Accordingly, it is the primary aim of the invention to provide a tamper workhead that can be economically manufactured and maintained while also being capable of heavy duty tamping.

In more detail, it is an object of the invention to provide a workhead of the above character that utilizes only two vibration producing motors per rail but which tamps with both vibratory and squeezing action in the critical region beneath the tie portions underlying the rail.

Another object is to provide a workhead as referred to above that gives a controlled squeezing action in tamping under the tie, in that force is exerted from both sides of the tie but with there being some balancing or floating of the tamping forces so as to best consolidate the ballast.

A further object is to provide a workhead of the above type in which the vibration is isolated and controlled by relatively quiet, economical and easily maintain elastomeric mounts.

Other objects and advantages of the invention will become apparent upon reading the following detailed description and upon reference to the drawings, in which.

Figure 2:
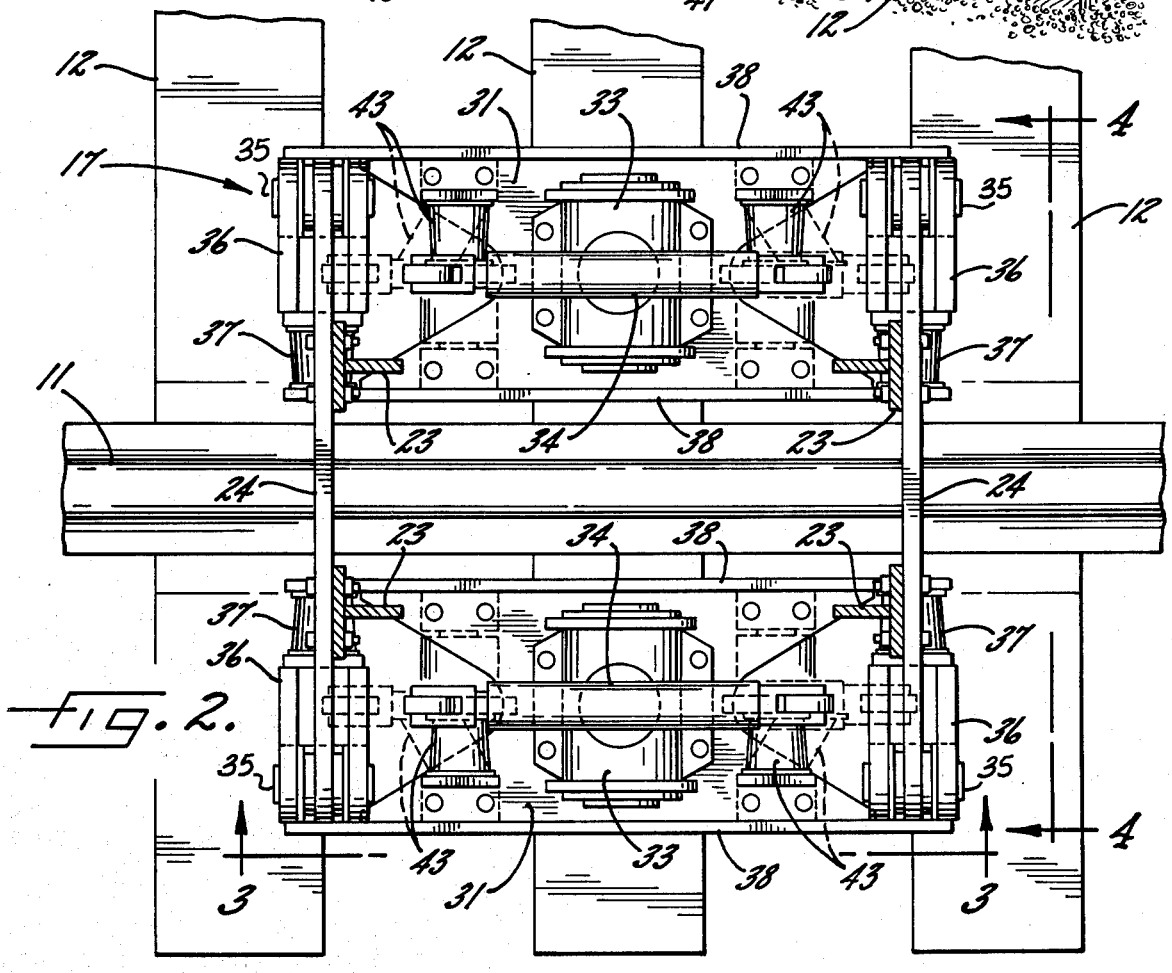
FIG. 2 is an enlarged partially sectioned plan of one of the workheads shown in FIG. 1.
Figures 3, 3A:
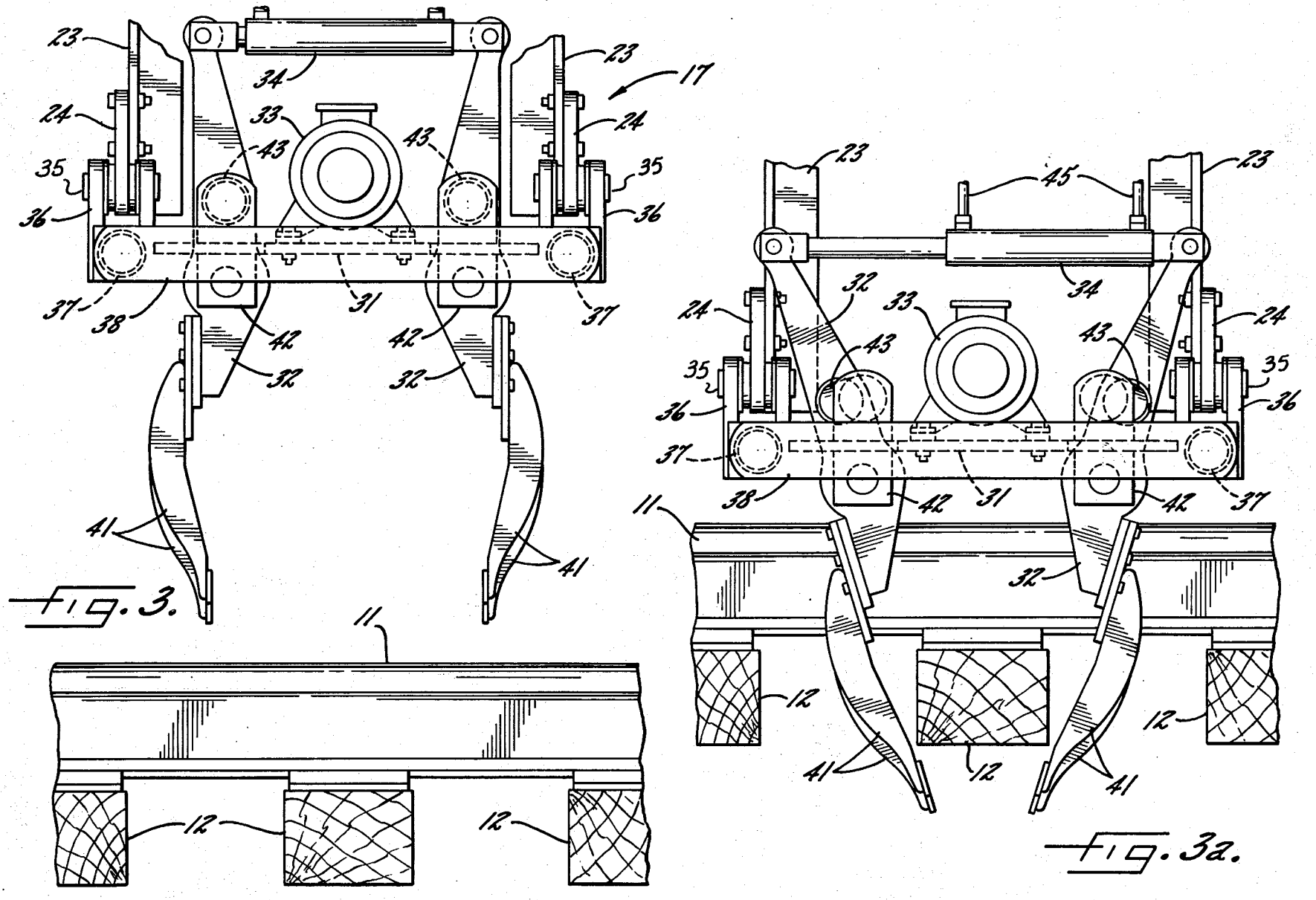
Figure 4A:
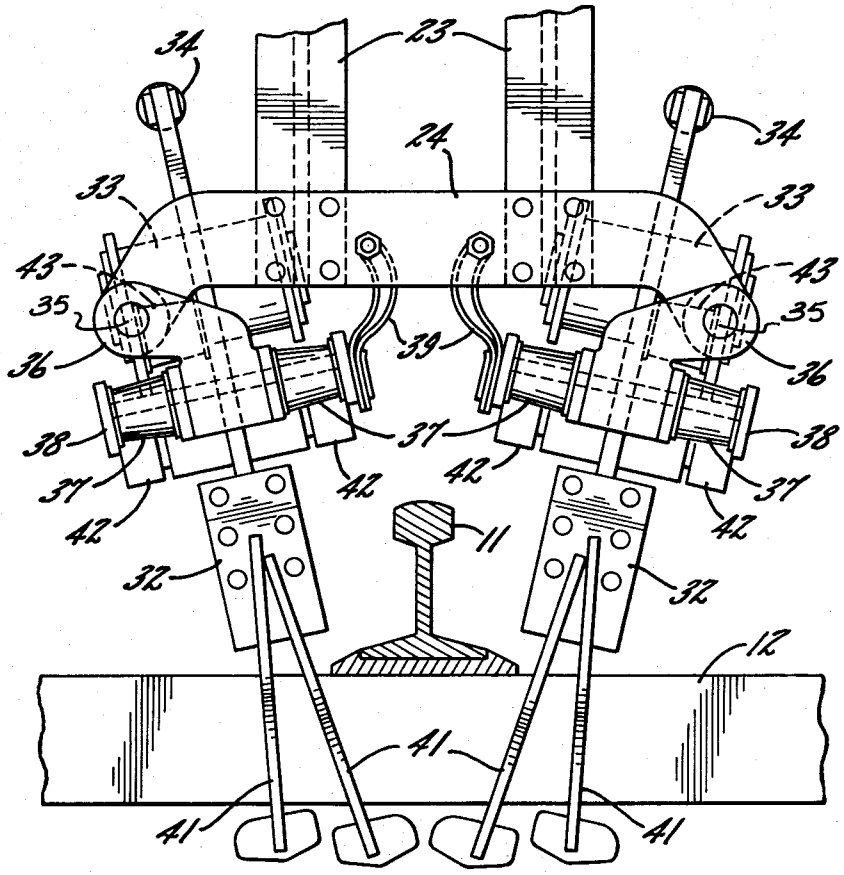
Figure 4:
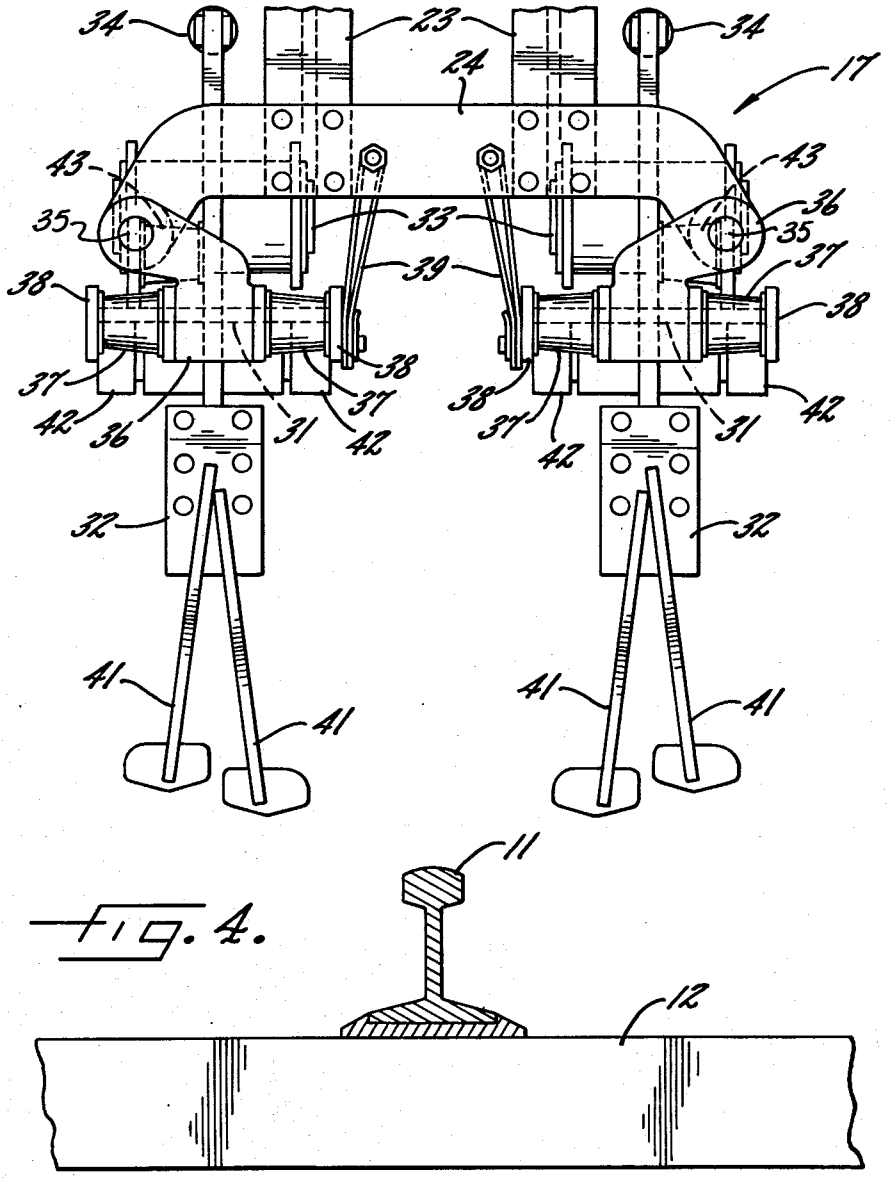

FIGS. 3 and 3*a* are partial elevations taken approximately along the line 3—3 in FIG. 2 showing the parts in alternate working positions; and FIGS. 4 and 4*a* are partial elevations taken approximately along the line 4—4 in FIG. 2 showing the parts in alternate operating positions.

While the invention will be described in connection with a preferred embodiment, it will be understood that I do not intend to limit the invention to that embodiment. On the contrary, I intend to cover all alternatives, modifications and equivalents as may be included within the spirit and scope of the invention as defined by the appended claims.

Figure 1:
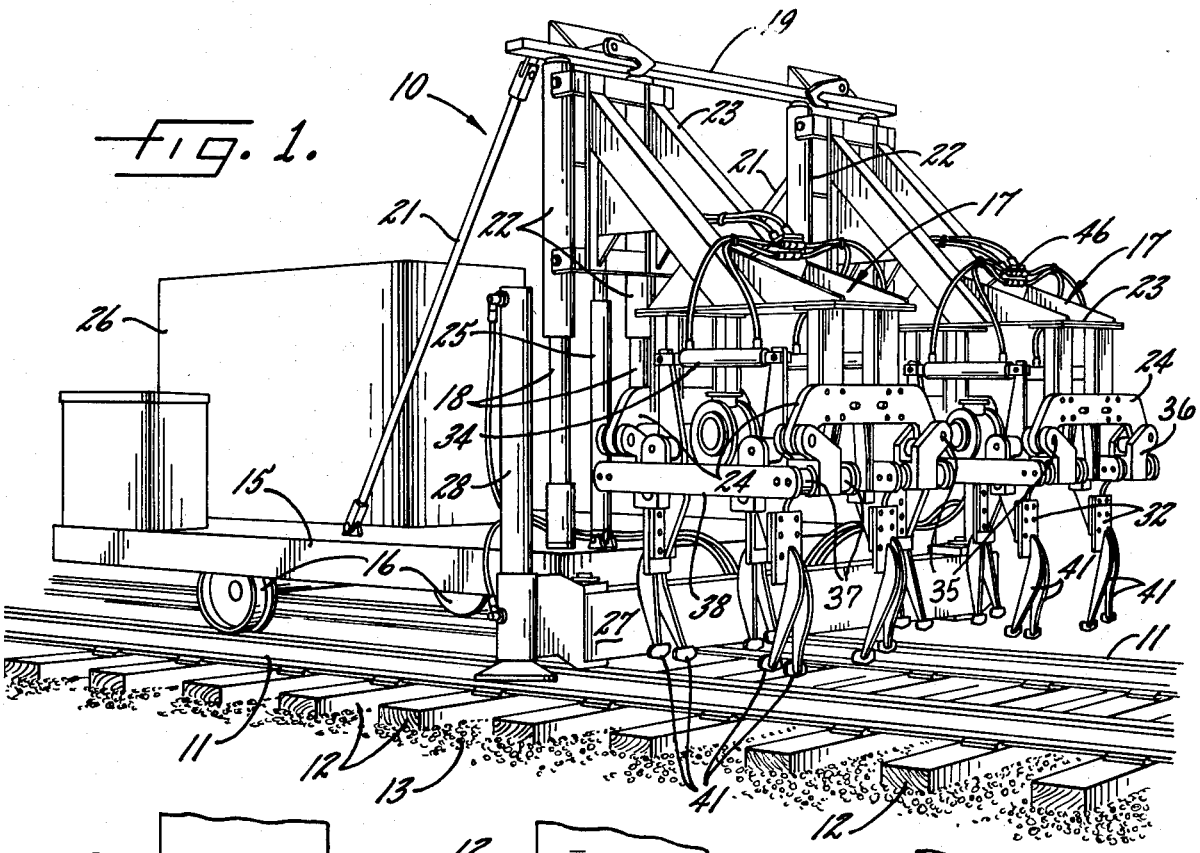
FIG. 1 is a front perspective of an on-track tamper embodying the invention.

Turning to the drawings, there is shown in FIG. 1 an on-track tamper 10 embodying the invention and riding on a railroad track including a pair of rails 11 mounted on cross ties 12 supported in ballast 13. The tamper 10 includes a main frame 15 supported on flanged wheels 16 engaging the rails 11, and a pair of workheads 17 are cantilevered forwardly of the main frame. The workheads 17 are mounted for independent vertical positioning on columns defined by shafts 18 secured to the main frame 15 at their lower ends and braced upright by a tie bar 19 and links 21. The workheads include cylinders 22 slidable on the shafts 18, and rigid beam and rib structures 23 extending from the cylinders 22 and terminating in pairs of cross arms 24 mounted transversely above each rail 11.

For vertically positioning the workheads 17, hydraulic actuators 25 interconnect the main frame 15 and the workhead structures 23. The tamper 10 also includes a power plant 26 providing power for both translating the tamper down the track and for developing hydraulic power for the actuators 25 and other hydraulic components. The tamper is controlled from an operator's station located, as is conventional, on the main frame just behind and between the workheads 17.

In the illustrated embodiment, the tamper also includes a track jack comprising a floating bear 27 supported on the main frame 15, and ground engaging hydraulic jacks 28 mounted on each end of the beam 27. Rail clamps, not shown, also comprise elements of the track jack which operates in the conventional fashion to raise the track for tamping.

In accordance with the invention, each workhead 17 has a pair of platforms 31 pivoted on the pair of cross arms 24 (one platform on each side of the underlying rail 11), a pair of tamping blades 32 are pivoted on each of the platforms 31 on axes parallel to and spaced wider than the width of the ties 12, a single vibration motors 33 is mounted one on each of the platforms 31, an actuator 34 is coupled between each pair of blades 32 and the platform-cross arm pivots 35 are disposed laterally of the rails outwardly of the blades 32 so that movement of the blades into the ballast results in an upward force on the platform, a moment force about the pivots 35 and the rotation of the platform about pivots 35. Such rotation of the platform together with the extension of the actuators 34 causes the blades 32 to tamp the region beneath the tie portions underlying the rails.

In the illustrated embodiment, the platforms 31 are pivoted on the cross arms 24 through bifurcated elbows 36 which are sandwiched between elastomeric elements 37, of the Lord-mount type, anchored to side plates 38 forming part of the platforms 31. The elements 37 isolate platform vibration from the cross arms 24 yet control the position of the platforms. The platform-cross arm pivots 35, as best seen in FIGS. 4 and 4*a*, are further from the rail 11 than the blades 32, and flexible straps 39 interconnecting the cross bar 24 and the platforms 31 hold the platform substantially horizontal when the workhead is elevated. When the workhead is lowered driving the blades 32 into the ballast 13, the location of the platform pivots relative to the blades urge the blades toward and under the rail 11 (see FIG. 4*a*).

The blades 32, in this case each blade includes double tamping paddles 41, are pivoted between blocks 42 fixed to the undersides of the platforms 31. Blade position is controlled by interconnecting each blade and its supporting platform through an elastomeric element 43 similar to the elements 37. Each blade is thus resiliently held in a substantially vertical position on the platforms 31 and, when the actuators 34 are extended, the elements 43 are deformed in shear, see FIG. 3*a* and the dashed lines in FIG. 2.

In carrying out the invention, hydraulic lines 45 running to opposite ends of the actuators 34 are connected at junction blocks 46 (see FIG. 1) so that both actuators on one of the workheads 17 will inherently develop approximately the same force. Thus, if one pair of blades 32 encounters greater resistance to squeezing movement than the other blade pair, the blade pair encountering the lesser resistance will move further keeping the squeezing forces balanced. Moreover, considering each pair of the blades 32 being squeezed by one of the actuators 34, if one blade of that pair encounters greater resistance than the other, its pivoting movement will halt and the opposite blade will continue movement keeping the forces exerted by the blades substantially uniform. This balancing of forces in the ballast is not quite exact since the elements 43 act as springs resisting extension of the acuators 34, but generally all four of the blades on each of the workheads 17 exert a balanced squeezing force with the elements 43 insuring that all blades move at least partially under the tie.

Preferably, the vibration motors 33 are hydraulically powered, containing eccentric weights being rapidly rotated by a hydraulic motor, the entire assembly being substantially one unit. Such components are commonly used as foundry shaker motors.

Those skilled in the art will appreciate that the tamper workheads 17 are, for this class of apparatus, simple and straightforward in design so as to be capable of economical manufacture and maintenance. Nevertheless, the workheads effectively tamp the critical area of a tie underlying the rail and are sufficiently rugged for heavy duty tamping. One aspect of the economy achieved is that only two vibration motors per workhead are required although each workhead uses, in effect, four independently movable blades.

The combination of vibration and squeezing action makes for tamping effectiveness and, as described above, there is a balancing of tamping forces on each workhead that makes particularly efficient use of the squeezing action.

I claim as my invention:

1. In a tamper having a workhead support horizontally translatable and vertically positionable relative to a rail mounted on cross ties supported in ballast, the combination comprising, a pair of cross arms mounted on said support transversely to said rail, a pair of platforms pivoted on said cross arms with one platform on each side of said rail, two pairs of tamping blades one pair pivoted on each of said platforms on axes parallel to and spaced wider than the width of said ties, a single vibration motor mounted on each of said platforms for transmitting vibration to said blades, a pair of actuators with one actuator coupling each pair of blades for squeezing the blades toward a tie, said platform-cross arm pivots being disposed laterally of said rail and outwardly of said blades so that downward movement of the blades into the ballast tilts the platform and the blades of each pair toward the rail, and means for vertically positioning said support between a travel position when said blades are clear of said rail, ties and ballast to a working position when said blades are inserted into the ballast for tamping the ballast region beneath the tie portions underlying the rail.

2. The combination of claim 1 including elastomeric elements interconnecting said blades and said platform for resiliently holding each blade independently in a substantially vertical position on its pivot.

3. The combination of claim 1 in which said pair of actuators are hydraulic and are interconnected by means for substantially equalizing the forces exerted by all four blades.

4. The combination of claim 1 including elastomeric elements resiliently coupling said platforms to said platform-cross arm pivots for substantially isolating platform vibration from said cross arms.

5. The combination of claim 4 including flexible straps for holding said platform substantially horizontal when the blades are clear of the ballast.

* * * * *